United States Patent [19]

Chia et al.

[11] 3,972,709

[45] Aug. 3, 1976

[54] METHOD FOR DISPERSING GAS INTO A MOLTEN METAL

[75] Inventors: Enrique C. Chia, Carrollton, Ga.; Helge Ole Forberg, Owensboro, Ky.

[73] Assignee: Southwire Company, Carrollton, Ga.

[22] Filed: Apr. 23, 1975

[21] Appl. No.: 570,673

Related U.S. Application Data

[63] Continuation-in-part of Ser. No. 367,085, June 4, 1973, abandoned.

[52] U.S. Cl. ..... 75/93 R; 75/61; 75/68 R; 75/93 AC

[51] Int. Cl.[2] ..... C22B 9/00

[58] Field of Search ..... 75/93 R, 68 R, 61, 93 AC; 261/87; 266/34 A, 34 T

[56] References Cited

UNITED STATES PATENTS

| | | | |
|---|---|---|---|
| 1,759,282 | 5/1930 | Schaefer | 261/87 |
| 3,015,554 | 1/1962 | Rommel | 75/61 |
| 3,743,263 | 7/1973 | Szekely | 75/68 R |
| 3,791,813 | 2/1974 | Ramachandran | 75/61 |

*Primary Examiner*—M. J. Andrews
*Attorney, Agent, or Firm*—Van C. Wilks; Herbert M. Hanegan; Stanley L. Tate

[57] ABSTRACT

A method of and apparatus for uniformly dispersing a gas into a molten metal bath by supplying gas to a rotatably mounted distributor located at a submerged zone beneath the bath surface while preventing physical contact between the gas and the molten metal; emitting the gas from the distributor in the form of a plurality of bubble jets into contact with the molten metal at said zone, said bubble jets exerting a reaction force on the distributor; and agitating the molten metal to effect uniform dispersion of the gas emitted therein by whirling the bubble jets in the molten metal, said whirling being accomplished by rotating the distributor in response to said reaction forces. The apparatus comprises a supply conduit connected at one end to a source of pressurized gas and connected at the other end to a rotatable hollow sleeve immersed in the molten metal. An array of apertures extend through the sleeve for discharging the gas into the molten metal in the form of numerous gas bubble jets and the apertures are arranged to discharge the gas bubble jets in mutually cooperative jetting directions to rotationally propel the sleeve about the supply conduit. The rotary movement of the sleeve causes the gas bubble jets to whirl about in the molten metal thereby agitating the molten metal to effect uniform dispersion of the gas within the molten metal.

7 Claims, 2 Drawing Figures

METHOD FOR DISPERSING GAS INTO A MOLTEN METAL

CROSS REFERENCE TO RELATED APPLICATION

This application is a continuation-in-part of copending application Ser. No. 367,085, filed June 4, 1973, now abandoned.

BACKGROUND OF THE INVENTION

The present invention relates to an apparatus for and method of introducing gas into a molten metal. It is often desired to introduce gases into molten metals, for example in the degassing and cleaning of molten metal such as aluminum. Usually the gases are introduced through open ended tubes extending into the molten metal with their open ends located close to the bottom of a containing vessel such as a crucible or a gassing bay of a reverberatory furnace. It is known that gases are more effective for their intended purpose when introduced into the molten metal in the form of fine bubbles through some form of porous refractory brick or porous refractory member. When porous bricks are used, it is not practical to immerse these repeatedly into liquid metal since failure soon occurs due to thermal shock.

Better results have been obtained by building the porous components into the wall or floor of the containing vessel so that the components are well supported laterally against cracking. However, it is only a matter of time before the coarse components block up and fail to pass the gas at a satisfactory rate even when the gas is supplied under considerable pressure.

Good results have been obtained with porous refractory diffuser tubes made of porous graphite or low porosity graphite cemented to porous carbon and inserted horizontally through a wall of the containing vessel. However, these horizontally disposed tubes cannot be replaced without taking the container out of service, which is particularly disadvantageous if the container forms a part of a continuous process.

Diffusers of predominately carbonaceous material have other disadvantages. When used for introducing some gases into certain metals, for example, nitrogen into molten aluminum, they lead to fouling of the metal. It is difficult to make a gastight joint between the diffusers and the gas supply lines and the joints often fail through oxidation of the material. Attempts have been made to construct diffusers of shapes that would give more satisfactory introduction of the gas into liquid metal by making the diffusers of two or more parts, but the joining of the parts has presented difficulties, both initially and during use.

The method and apparatus of the present invention overcomes the above mentioned prior art deficiencies by supplying the gas through a supply conduit connected at one end to a source of pressurized gas and connected at the other end to a rotatable hollow sleeve immersed in the molten metal. An array of appertures extend through the sleeve for discharging the gas into the molten metal in the form of numerous gas bubble jets and the appertures are arranged to discharge the gas bubble jets in mutually cooperative jetting directions to rotationally propell the sleeve about the supply conduit. The rotary movement of the sleeve causes the gas bubble jets to whirl about in the molten metal, thereby agitating the molten metal to affect uniform dispersion of the gas within the molten metal.

SUMMARY OF THE INVENTION

A method for uniformly dispersing a gas into a molten metal bath comprises supplying a pressurized gas into the molten metal to a submerged zone located beneath the bath surface, and flowing the gas from the submerged zone outwardly into the molten metal in the form of numerous gas bubble jets while simultaneously whirling the gas bubble jets about in the molten metal to effectively agitate the molten metal to effect uniform dispersion of the gas within the molten metal. The energy for whirling the gas bubble jets about in the molten metal is derived solely from the continuous change of momentum of the flowing gas as the gas is discharged into the molten metal and no additional energy input is needed to effect agitation of the molten metal.

The present invention pertains generally to a technique for distributing a gas in a molten metal and more particularly, pertains to a method and device for uniformly dispersing a gas in a molten metal prior to forming the molten metal into metal products.

There are numerous metallurgical operations where a gas must be dispersed within a molten metal while the metal is in the molten state. For example, in the formation of alloys, such as aluminum-based alloys, it is possible to entrain metallic alloying particles in a carrier gas and then introduce the carrier gas into the molten aluminum to uniformly distribute the alloying particles within the melt. It is also frequently necessary to pass an inert gas through the molten metal to degas the melt of undesirable dissolved gases. Another use of the gas is as a fluxing agent for fluxing the molten metal prior to its being cast into metal products.

One technique used in the art to introduce gas into a molten metal bath requires a person to manually immerse a gas-carrier pipe beneath the surface of the molten metal bath so that gas supplied through the carrier pipe is discharged into the molten metal. This technique is undesirable since the person manipulating the carrier pipe is subjected to noxious fumes and intense heat radiation. Moreover, this technique does not effect the uniform dispersion of the gas in the molten metal and even when the person manually stirs the metal bath with the carrier pipe, the gas is insufficiently intermixed and distributed within the metal.

Another approach used in the art is to introduce the gas into the molten metal bath through an orifice plate attached to the end of a stationary pipe which is immersed in the bath. The orifice plate distributes the gas in the form of bubbles into the molten metal bath, but this approach has not proven satisfactory since insufficient agitation is imparted to the molten metal bath with the disadvantageous result that bubble distribution gradients are created in the bath and a non-uniform gas distribution is obtained.

Another technique employed in the art is to introduce the gas into the molten metal bath through an entrance valve located at the bottom of the vessel which contains the molten metal bath. The entrance valve is intermittently opened to allow the gas to bubble into the bath but like the former technique, this approach does not result in a uniform dispersion of the gas bubbles in the molten metal. Moreover, some type of automatic control must be used to periodically open the entrance valve, thereby adding additional cost to the operation or the entrance valve must be manually regulated, thereby requiring additional personnel.

It is therefore a primary object of the present invention to provide a method and device for uniformly dispersing a gas into a molten metal bath.

It is another object of the present invention to provide a method and apparatus for uniformly dispersing a gas into a molten metal bath by distributing the gas in the form of numerous gas bubble jets into the molten metal bath while whirling the discharging jets to agitate the molten metal bath and uniformly disperse the gas bubbles in the molten metal.

It is still another object of the present invention to provide a method and device for discharging the gas into the molten metal in the form of gas bubble jets and utilizing the continuous change of momentum of the flowing gas to effect rotational whirling of the discharging jets within the molten metal, thereby agitating the molten metal to promote uniform dispersion of the gas bubbles within the molten metal bath.

It is a further object of the present invention to provide a method and device for uniformly dispersing a gas into a bath of molten metal in the form of small bubbles in order to provide the desired reactive bubble surface area per given volume of gas, thereby increasing the reaction time between the gas bubbles and the molten metal.

It is yet another object of the present invention to provide a method and device for distributing gas into a molten metal in the form of bubbles and having means for preselecting the bubble size in order to obtain the optimum reactive bubble surface area per unit volume of gas.

DESCRIPTION OF THE PREFERRED EMBODIMENT

Figure 1:
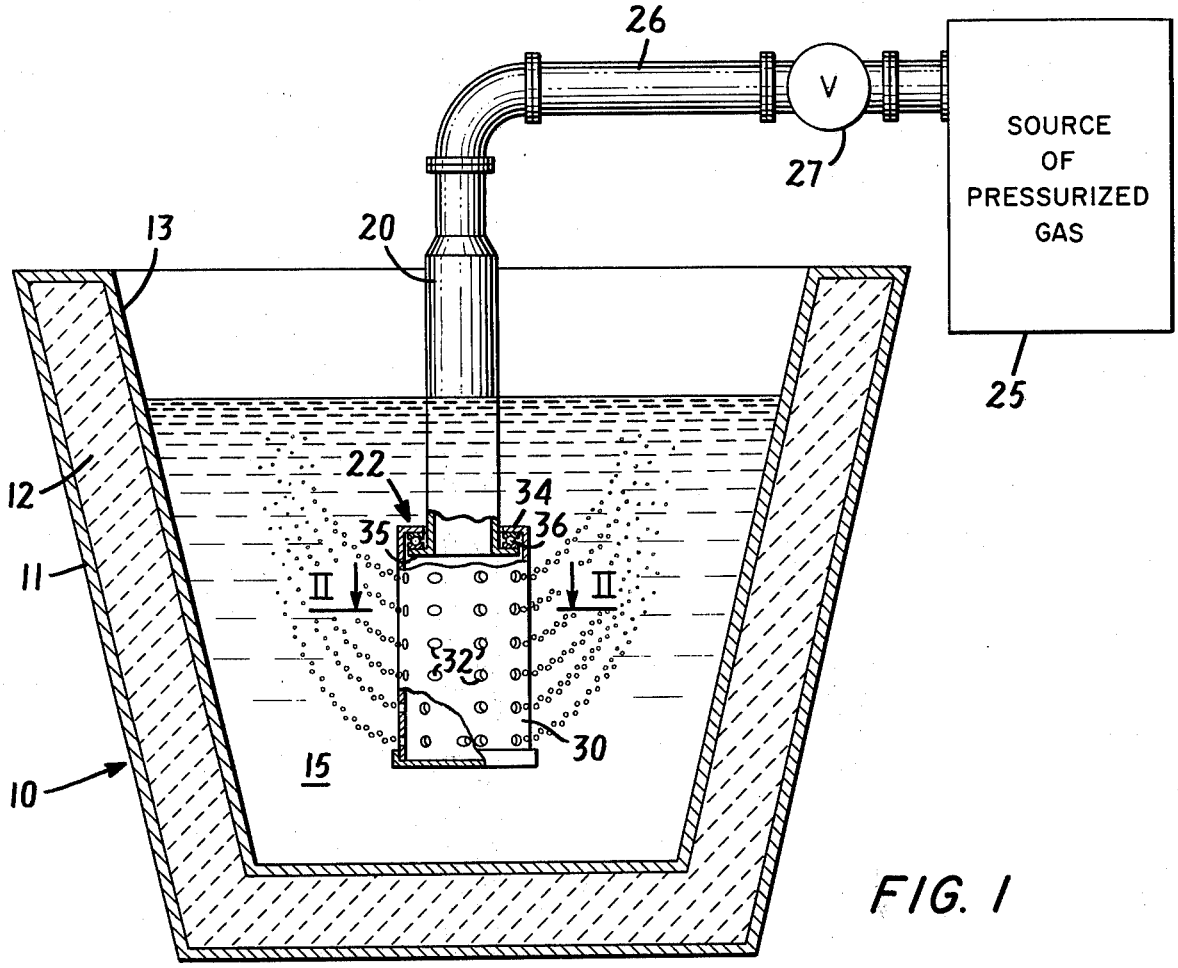

The above and other objects of the present invention are carried out by a device comprising a supply conduit connectable to a source of pressurized gas, and rotatable distributing means rotatably connected to one end of the supply conduit and completely immersed in the molten metal bath for distributing the gas into a molten metal. The distributing means comprises a hollow tubular sleeve mounted for free rotational on one end of the supply conduit and having an array of apertures therein for discharging the gas therethrough into the molten metal in the form of numerous gas bubble jets. The apertures extend linearly through the cylindrical wall of the sleeve at an oblique angle with respect to the sleeve radii so that the gas bubble jets are discharged from the sleeve at an oblique angle rather than in a radial direction and due to the rotational mounting of the sleeve, the discharging jets rotationally propel the sleeve. The rotary movement of the sleeve causes the gas bubble jets to rotationally whirl and swirl about in the molten metal thereby agitating the molten metal and promoting a more uniform dispersion of the gas bubbles in the molten metal.

The method comprises supplying the gas into the molten metal bath to a submerged zone located beneath the bath surface while preventing physical contact between the gas and molten metal and then flowing the gas from the submerged zone outwardly into the molten metal in the form of numerous gas bubble jets while simultaneously rotating the discharging jets to effectively agitate the molten metal and uniformly disperse the gas bubbles within the molten metal. The energy for effecting rotation of the jets is obtained solely by the kinetic energy of the discharging jets and no additional energy need be applied to the system.

Figure 2:
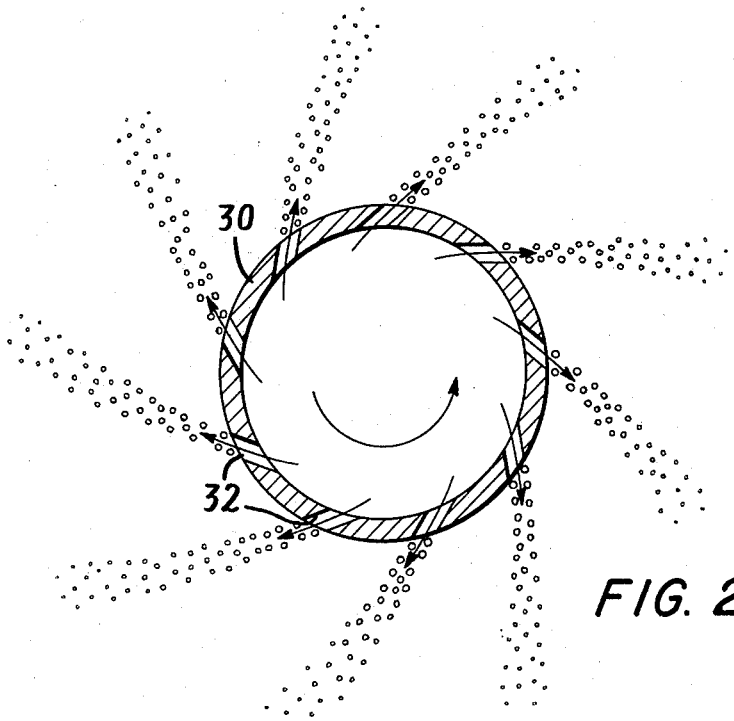

Having in mind the above and other objects that will be evident from an understanding of this disclosure, the present invention comprises the combinations and arrangements of parts as illustrated in the presently preferred embodiment of the invention which is hereinafter set forth in sufficient detail to enable those persons skilled in the art to clearly understand the function, operation, construction and advantages of it when read in conjunction with the accompanying drawings, wherein like reference characters denote like parts in the various views, and wherein:

FIG. 1 is an elevational side view, partly in section, of a device constructed in accordance with the principles of the invention and showing same in a typical operating environment; and FIG. 2 is a cross-sectional view taken along the line II—II in FIG. 1.

The invention will now be described with reference to FIG. 1 which shows the device during use in a system for introducing and dispersing a gas into a bath of molten metal. A vessel 10 is provided for temporarily holding a bath of molten metal and the vessel is of well-known construction. The vessel 10 comprises an outer lining 11, a layer of heat-insulation refractory material 12, and an inner lining 13 composed of corrosion-resistant material. The vessel 10 is used in conjunction with material charging, the discharging apparatus for charging molten metal into the vessel and for discharging the treated metal from the vessel has been omitted for the sake of clarity and does not constitute part of the present invention.

The device of the invention is inserted into the open top of the vessel 10 and immersed in a bath of molten metal 15 contained in the vessel 10. The device is retained in the position shown by any type of well-known bracket assembly or support assembly. The device comprises a supply conduit 20 for supplying gas into the molten metal bath at a location beneath the bath surface, and rotatable distributing means 22 for distributing the gas into the molten metal bath in the form of numerous gas bubble jets.

The supply conduit 20 comprises a section of hollow pipe connected at its upstream end to a source of pressurized gas 25 through a pipe network 26. The source of pressurized gas 25 is appropriately chosen depending upon the particular treatment which is to be carried out in the molten metal bath. For example, the gas may comprise a carrier gas for carrying metallic alloying particles, an inert gas to carry out a degasing operation, or a fluxing agent to effect a fluxing operation. A control valve 27 is inserted in the pipe network 26 for controlling the flow of gas into the molten metal bath.

The rotatable distributing means 22 comprises a hollow member 30 preferably having the shape of a hollow tubular sleeve. The tubular sleeve 30 is rotatably mounted upon the downstream end of the supply conduit 20 and an array of apertures 32 are provided in the sleeve 30 for discharging the gas into the molten metal bath in the form of gas bubble jets. The bottom end of the hollow tubular sleeve 30 is closed by a cover member so that fluid communication between the molten metal bath 15 and the interior of the sleeve is provided only through the array of apertures 32.

The means for rotatably mounting the sleeve 30 comprises a circular flange 34 connected to the topmost end of the sleeve 30, another circular flange 35 connected to the lowermost end of the supply conduit 20 and extending in spaced opposition from the flange 34, and a rotary thrust bearing 36 interposed between the flanges, thereby mounting the sleeve 30 for free rotational movement about the supply conduit 20. The weight of the tubular sleeve is supported by the supply conduit and the sleeve is mounted coaxially with the supply conduit to minimize any tendency of the sleeve to wobble or vibrate during its rotation. The sleeve 30 may be replaced by other sleeves having different sized apertures which are dimensioned in accordance with the particular gas treatment to be effectuated.

The particular arrangement of the apertures 32 is shown in more detail in FIG. 2. The apertures are disposed in circumferential rows which are equidistantly spaced-apart along the length of the sleeve 30 and the apertures in each circumferential row are disposed in circumferentially and equidistantly spaced-apart relationship around the sleeve 30. The apertures extend obliquely through the side wall of the sleeve when the sleeve is viewed in cross-section as shown in FIG. 2. Each aperture extends linearly through the sleeve and each aperture has an inner end which opens interiorly of the sleeve and an outer end which opens exteriorly of the sleeve at a circumferentially spaced location along the sleeve wall relative to the inner end. In other words, the apertures are formed in the sleeve 30 at an oblique angle relative to the radial directions of the sleeve and all of the apertures are slanted in the same directional sense about the sleeve so as to direct the gas outwardly at prescribed angles relative to the sleeve. By such an arrangement, the gas discharging through the apertures will apply a propulsive force to the sleeve and rotationally drive the sleeve about the supply conduit 20, as described in more detail hereinafter.

The gas jets discharged through the apertures are in the form of gas bubble jets and the individual apertures are dimensioned sufficiently small so that very tiny bubbles are discharged into the molten metal. Preferably, the apertures are designed to form as small a bubble as possible in order to provide the maximum reactive bubble surface area per given volume of gas, thereby increasing the contact area between the molten metal and the gas and accordingly decreasing the reaction time.

The numerous gas bubble jets which discharge from the apertures 32 are discharged in mutually cooperative jetting directions to rotationally propel the sleeve 30 about the supply conduit 20. This is a very important feature of the invention since as the sleeve 30 rotates, the gas bubble jets are swirled and whirled about in the molten metal bath thereby agitating the molten metal below the metal surface to promote more uniform contact between the gas and the molten metal. Thus, in accordance with the principles of the present invention, the device distributes the gas into the molten metal and imparts both an outward movement and a whirling motion to the gas bubbles to effect a uniform dispersion of the gas within the molten metal.

The rotatable distributing means thus functions as a jet propulsion device and converts the continuous change of momentum of the flowing gas stream into a propulsive force which propels the sleeve 30 in a rotational direction as indicated by the arrow in FIG. 2. The propulsive force applies a torque to the sleeve 30 and the sleeve is continuously rotated by the jet action of the discharging gas bubbles. Thus it may be appreciated that the distributing means distributes the gas in the form of numerous gas bubble jets and utilizes the continuous change of momentum of the flowing gas to effect rotational movement of the sleeve accompanied by a corresponding whirling rotation of the jets.

The operation of the device will now be described assuming that the vessel 10 is charged with a molten aluminum bath and that the source of pressurized gas 25 comprises a non-reactive gas component and a reactive gas component which are to be uniformly dispersed within the bath. The device is inserted into the vessel 10 so that the distributing means 22 is submerged in the molten aluminum. The control valve 27 is opened to allow gas flow through the pipe network 26 into the supply conduit 20 which supplies the gas to the sleeve 30. The gas is discharged through the sleeve apertures 32 in the form of gas bubble jets and the discharging jets effect rotational driving of the sleeve 30. The rotational movement of the sleeve 30 whirls the gas bubble jets about within the molten aluminum and the whirling motion of the jets combined with the outward movement of the jets effectively agitate and turbulize the molten aluminum to uniformly disperse the gas within the molten metal.

Advantageously, the gas used in the practice of this invention is a reactive gas such as chlorine, aluminum chloride, a chlorine-containing gas, fluorine, aluminum fluoride, hydrofluoric acid, activated nitrogen, monoatomic nitrogen, carbon monoxide, dichlorodifluoromethane, halogenated hydrocarbons and mixtures thereof. The term halogenated hydrocarbons as used herein includes freon 11 ($C\ Cl_3F$), freon 13 ($C\ ClF_3$), freon 113 ($C_2Cl_3F_3$), freon 114 ($C_2Cl_2F_4$), freon 115 ($C_2ClF_5$), freon 116 ($C_2F_6$) and freon C-318 ($C_4F_8$). Alkyl derivatives of freon and fluorine may also be used, however because of cost and safety considerations, they are not as advantageous as the earlier listed reactive gases. Solid reactive components such as lithium nitride, aluminum nitride, magnesium chloride, alkali metal chlorides, alkali metal fluorides, alkaline earth metal chlorides, alkaline metal earth fluorides and mixtures thereof may also be used in the practice of this invention.

In accordance with this invention, the gas may have one or more of the above listed reactive components and another component which is a non-reactive, diluent gas. Suitable non-reactive diluent gases include helium, neon, argon, krypton, xenon, nitrogen, carbon dioxide and mixtures thereof. If a non-reactive diluent gas is a component of this invention, the ratio of non-reactive gas to reactive component advantageously is from about 9:1 to about 1:9.

The invention has been described in conjunction with one particular embodiment and it is to be understood that the obvious modifications and changes may be made without departing from the spirit and scope of the invention as defined in the appended claims and the invention is intended to cover all such modifications and changes which fall within the scope of the claimed invention.

What is claimed is:

1. A method of fluxing molten metal to remove dissolved gases and non-metallic impurities therefrom comprising the steps of:

a. providing a fluxing gas which at least partially includes a component that is non-reactive with the molten metal;

b. supplying the gas to a rotatably mounted distributor located at a submerged zone beneath the surface of the molten metal at a positive pressure sufficient to prevent physical contact between the gas and the molten metal upstream of the distributor;

c. emitting the gas from the distributor into the molten metal in a plurality of very small bubble jets extending in a direction oblique to radial lines extending perpendicular to the axis of rotation of the distributor, said jets having a tangential component which exerts a reaction force on the distributor; and d. rotating the distributor solely in response to said reaction force in a direction opposite to the direction of said bubble jets emitted therefrom, thereby substantially preventing bubble coalescence in the region of the distributor and thus effecting uniform and complete dispersion of the bubbles through the molten metal.

2. A method according to claim 1 wherein the step of supplying gas to the distributor includes continuously passing the gas downwardly to said submerged zone from above the surface of the molten metal through a conduit extending into the metal and maintaining the conduit fixed with respect to the molten metal while rotating the distributor to effect whirling of the bubble jets, thereby preventing turbulence at the surface of the metal and thus inhibiting the inclusion of ambient gas therein.

3. The method of claim 1 wherein the non-reactive component is selected from the group consisting of helium, neon, argon, krypton, xenon, nitrogen, carbon dioxide and mixtures thereof.

4. The method of claim 1, said gas further including a reactive component, and wherein the ratio of non-reactive components to reactive component is from about 9:1 to about 1:9.

5. The method of claim 1 wherein the gas has a reactive component.

6. The method of claim 5 wherein the reactive component of the gas is selected from the group consisting of a chlorine-containing gas, aluminum chloride, fluorine, aluminum fluoride, hydrofluoric acid, nitrogen, monatomic nitrogen, carbon monoxide, dichlorodifluoromethane, halogenated hydrocarbons and mixtures thereof.

7. The method of claim 5 wherein the reactive component of the gas is selected from the group consisting of lithium nitride, aluminum nitride, alkali metal chlorides, alkali metal fluorides, alkaline earth metal chlorides, alkaline earth metal fluorides and mixtures thereof.

* * * * *